US005236092A

United States Patent [19]

Krotkov et al.

[11] Patent Number: 5,236,092

[45] Date of Patent: Aug. 17, 1993

[54] METHOD OF AN APPARATUS FOR X-RADIATION SORTING OF RAW MATERIALS

[76] Inventors: Mikhail I. Krotkov, prospekt Entuziastov, 45, korpus 2, kv. 275; Vladimir I. Revnivtsev, Morskaya naberezhnaya, 15, kv. 380; Irik S. Sataev, alleya Polikarpova, 5, kv. 144; Nikolai F. Vasiliev, ulitsa Dekabristov, 16, kv. 39; Vladimir S. Ponomarev, ulitsa Stasovoi, 2, kv. 363, all of Leningrad, U.S.S.R.

[21] Appl. No.: 908,577

[22] Filed: Jun. 24, 1992

Related U.S. Application Data

[63] Continuation of Ser. No. 613,645, Dec. 3, 1990, abandoned.

[51] Int. Cl.[5] ..... B07C 5/02

[52] U.S. Cl. ..... 209/539; 198/609; 209/541; 209/542; 209/589; 209/920

[58] Field of Search ..... 209/539, 540, 541, 542, 209/589, 914; 198/609

[56] References Cited

U.S. PATENT DOCUMENTS

| | | | |
|---|---|---|---|
| 3,011,634 | 12/1961 | Hutter et al. | 209/589 X |
| 3,356,211 | 12/1967 | Mathews | 209/920 X |
| 3,545,610 | 12/1970 | Kelly et al. | 209/920 X |
| 3,581,888 | 6/1971 | Kelly et al. | 209/74 |
| 3,872,306 | 3/1975 | Palmer | 209/589 X |
| 4,194,634 | 3/1980 | Kelly | 209/914 X |
| 4,365,719 | 12/1982 | Kelly | 209/914 X |
| 4,549,659 | 10/1985 | Hawkins et al. | 209/589 X |
| 4,848,590 | 7/1989 | Kelly | 209/589 X |

FOREIGN PATENT DOCUMENTS

| | | |
|---|---|---|
| 1158748 | 12/1983 | Canada . |
| 1242260 | 9/1988 | Canada . |
| 952384 | 8/1982 | U.S.S.R. . |
| 1212631 | 2/1986 | U.S.S.R. . |

*Primary Examiner*—Andres Kashnikow
*Assistant Examiner*—Joseph A. Kaufman
*Attorney, Agent, or Firm*—Keck, Mahin & Cate

[57] ABSTRACT

In a method of X-radiation sorting of raw materials, after the stock lumps have been spread in monolayer on the transporting surface and stabilized, they are brought into the mode of unsupported movement along the stabilized paths without rotation. The exposure of the lumps to X-radiation, the measurement of the secondary radiation from the lumps, and the selection thereof are all carried out during this unsupported movement of the lumps. An apparatus for X-radiation sorting of raw materials comprises a steeply inclined vibrating feeder (4) conjugate to a preceding slightly inclined vibrating feeder (3) with a stabilizer (5) located thereabove for stabilizing the lumps of the stock. Over a section (14) of joining the conjugate vibrating feeders (3,4), there is disposed a second stabilizer (6) compensating for the lump torques produced at the point where the lumps pass onto the vibrating feeder (4). A coordinate system (7), X-radiation sources (8), X-radiation detectors (9), and actuators (10) for selection of standard lumps are all arranged after the vibrating feeder (4), looking downstream.

2 Claims, 1 Drawing Sheet

METHOD OF AN APPARATUS FOR X-RADIATION SORTING OF RAW MATERIALS

This is a continuation of application Ser. No. 07/613,645, filed Dec. 3, 1990, now abandoned which is the national stage of PCT/SU 89/00087, filed Apr. 3, 1989.

FIELD OF THE INVENTION

The present invention relates to mining engineering and more particularly, to methods and devices for X-radiation sorting of raw materials, and can be used for preconcentration of mineral raw materials, secondary metallic raw materials, etc.

PRIOR ART

Known in the art is a method of X-radiation sorting of minerals (SU, A, 952384), wherein lumps of the raw material to be sorted are passed in sequence in front of the X-radiation source, the characteristic fluorescent X-radiation and the X-radiation scattered by the lump are measured simultaneously, whereupon the ratio of the intensity of the characteristic fluorescent radiation in the desired component to that of the scattered radiation from each lump is obtained, and the process of sorting is carried out according of the value of this ratio, by comparing it with a specified threshold. Here the intensity of the scattered radiation is recorded in the energy band corresponding to the photopeak of this radiation.

The method is implemented by a device (SU, A, 952384) comprising an isotope placed within a collimator, and X-radiation detectors formed by proportional counters disposed on either side of the isotope. The lumps of the stock to be sorted are passed, by free fall in front of the isotope and the counters.

The inherent disadvantage of this method and apparatus resides in that the stock lumps go past the isotope and the detectors, following different paths, and therefore, these elements and also the actuators providing the sorting of the lumps have to be sufficiently spaced from the mean path of the lumps to prevent them from touching said elements. It results in that the actuators must have a higher power, with the consequently reduced cost efficiency of the method, and leads to a lower sensitivity to secondary radiation.

The secondary X-radiation sensing properties are further degraded as a result of the stock lumps, in their free fall past the isotope and the proportional counters, being arbitrarily oriented with respect to them, i.e. with both the broader and the narrower sides of the lumps facing the elements. Since the time of exposure of the lumps to X-radiation is very short, the arbitrary orientation of the lumps relative to their travel direction may lead to the situation, when the lump with the valuable component content above the threshold, but with its narrow side facing the isotope, will be recognized as sub-standard, and consequently will be rejected. This results in a less efficient sorting.

Also known is a method of X-ray sorting of raw materials implemented in a device disclosed in the Scientific Information Bulletin "Obogoschenie rud", No. 3 (178), 1985, (Leningrad), A. P. Chernov et al. "Rudosortirovochny avtomat dlya pokuskovogo obogoschenia mineralnogo syrya", pp. 31 to 33). The method provides the arrangement of the lumps of the stock to be sorted in a single layer on the transporting surface, in a steady position, with the result that the lumps on the transporting surface move steadily along stabilized paths, without being tipped over or detached from the surface. As the lumps on the transporting surface move along, they are exposed to X-radiation, the secondary X-radiation after passing through them is measured, and standard lumps are selected according to the intensity of the secondary radiation.

The apparatus comprises a feed hopper, a transportation device including a slightly inclined vibrating feeder and a belt conveyer, and air actuators, all arranged in series, in the direction of stock travel. A stabilizer formed by a brush-type conveyer is placed above the conveyer belt, for holding the lumps against the belt and providing their stabilization. Located after the stabilizer, in the direction of the stock travel, below the conveyer belt, and evenly spaced over entire width are X-radiation sources mounted coaxially with X-radiation detectors arranged above the belt. The latter also act as a coordinate system to evaluate the size of the lumps and their position on the belt. The sorting apparatus is provided with a computer having its inputs connected to the outputs of the detectors and its outputs connected to the actuators.

The X-radiation sources and detectors form individual scanning zones over the width of the moving stock stream, and the actuators are located in each of said scanning zones at the point of leaving the conveyer belt. The bottom of the vibrating feeder chute exhibits an accelerating stepped profile, causing the travel speed of the stock lumps to be increased, the height of the stream correspondingly reduced, and making the lumps at the outlet of the feeder to move in one layer. On the conveyer, the stock lumps are forced against the belt surface by the stabilizer brushes and so positioned on the surface that they rest on the sides providing their steady position as they move along. As the stock lumps pass the X-radiation sources, the detectors sense the intensity of the secondary radiation passed through the lumps, while the computer processes the detector data in proportion to the amount of useful components contained in the lumps, and issues instructions to operate the appropriate actuators for selection of the standard lumps, the number of the actuators operated corresponding to the size of the lumps selected.

Because the lumps are in a stabilized position on the conveyer, they are arranged with that side facing the X-radiation sources, which is sufficiently large in area, if not the largest one, eliminating measurement errors inherent in the method and apparatus according to SU-,A,952384. However, the above method and apparatus fail to provide a sufficiently effective separation, because the detectors since the X-radiation that has passed through the lumps, which is but slightly dependent on the concentration of useful components contained therein. It is the characteristic secondary radiation that more fully represents the concentration of valuable components in the raw material. In the foregoing device, however, if the X-radiation sources and detectors are disposed on the same side with respect to the lumps, i.e. above the conveyer belt, the sensing of the radiation will not give the desired effect, since the conveyer belt will produce a high background radiation, impairing the measurement accuracy. So this sorting method will fail to sort lumps with a low ore concentration (less than 10%), and it can be only used at the ore preparation stage and for sorting of contrasting minerals such as shale and coal.

Another drawback of the foregoing method and apparatus is that the stock lumps, as they leave the conveyer belt, travel along non-stabilized paths, and so, similarly to the method according to SU,A,952384, the actuators must be sufficiently spaced from the lumps supplied, with the resulting significant power required for them.

DISCLOSURE OF THE INVENTION

The invention seeks to provide a method of and apparatus for X-radiation sorting of raw materials such that they permit measurement of the secondary X-radiation from the stock lumps without any background noise, while allowing the lumps to pass before the X-radiation sources and detectors and before the actuators providing selection of standard lumps, following stable paths, which results in a higher sorting effect and saves power required for operation of the actuators.

The problem is solved by providing a method of X-radiation sorting, comprising the steps of spreading the lumps of the stock to be sorted in a monolayer on the transporting surface, stabilizing them, determining the lump sizes and their positions across the width of the monolayer, exposing them to X-radiation, measuring the secondary radiation from each lump, and selecting the standard pieces depending on the measured results, wherein, according to the invention, after the lumps have left the transporting surface, they move unsupported in a monolayer, while maintaining the position of the lumps relative to their moving direction, the lump sizes and positions across the monolayer width being determined, the lumps being exposed to X-radiation, the secondary radiation measured, and the standard lumps selected during said unsupported travel of the lumps.

The problem is also solved by providing an apparatus for X-radiation sorting, comprising a feed hopper, a transportation device including a slightly inclined vibrating feeder for spreading the lumps of the stock to be sorted in monolayer, a stabilizer located above the transportation device for steadying the lumps, a coordinate system for determination of the lump size and their position across the monolayer, X-radiation sources, X-radiation detectors, actuators for selection of standard pieces, and a computer with its inputs connected to the outputs of the coordinate system and of the X-radiation detectors, and with its outputs connected to the actuators, wherein, according to the invention, the transportation device further comprises a steeply inclined vibrating feeder placed after the slightly inclined vibrating feeder in the downstream direction, in contact therewith, the apparatus being further provided with another stabilizer placed above the joint of the slightly inclined and steep vibrating feeders for suppression of lump torques generated as the lumps pass over to the steeply inclined vibrating feeder, the coordinate system, the X-radiation sources, the X-radiation detectors, and the actuators being all located after the steep vibrating feeder, looking downstream.

The sorting effect of the proposed method and apparatus is increased by making it possible, while moving the stock in an unsupported way, to detect both the secondary characteristic radiation of valuable components in the lumps and the scattered radiation from the lumps without background noise, similarly to the method of SU,A,952384. Unlike this known method, however, the proposed method provides the unsupported movement of the stock lumps, while maintaining their position relative to the travelling direction, i.e. without rotation and moving along stabilized paths. Such unsupported movement is ensured, in the proposed apparatus, by means of the steeply vibrating feeder and the second stabilizer. Since the stock lumps follow stabilized paths as they go past the X-radiation sources and detectors, and also past the coordinate system and the actuators, these elements are allowed to come closer to the lumps being analyzed, with the consequent increase in sensitivity of detecting the secondary X-radiation and the reduced actuator power.

BRIEF DESCRIPTION OF THE DRAWINGS

The invention is further illustrated by a detailed description of its preferred embodiment with reference to the accompanying drawings in which.

BEST MODE TO CARRY OUT THE INVENTION

The method of X-radiation sorting of raw materials, according to the invention, is as follows. The lumps of the stock to be sorted of a particular size range are fed onto a transporting surface which is slightly inclined. The lumps are spread in monolayer on the transporting surface by means of vibrofeeding and are separated from one another across the stream width. As the lumps further move on the transporting surface, each of them is stabilized, i.e. it is set on a face such that, resting on at least three points thereof, it can be moved without rolling over, the position on this face being invariably maintained. This face is not necessarily the largest in area of all the faces of the lump available: rather it is any supporting face which has a surface area large enough for the lump to move on steadily, without rolling. The existence of such faces in any lump is ensured by the production techniques used in obtaining rock pieces, i.e. by blasting or cleave crushing. In both cases, large lumps of the rocks are crushed along the lines of maximum weakness, i.e. microcracks or line directions of maximum compressive force. So it is such shapes as wedge, a plate, a bar, or an irregular relatively isometric polyhedron, rather than a circular shape, that are characteristic of rock lumps.

The lumps are then shifted from the slightly inclined transporting surface to the steep surface where an additional acceleration is imparted to them, causing each particular lump to be separated from the succeeding one. The torques produced in the lumps as they are accelerated, which are due to their being transferred to the steep path and to sliding friction, are eliminated by such means as mechanical techniques of compensating for the torque and by having the lumps move on the steep surface, using the vibrofeeding mechanism instead of sliding.

Upon leaving the steeply inclined transporting surface, the lumps move in monolayer without any support, keeping the path of the lumps similar in position across the width of the stream unaltered and without changing their position with respect to the travelling direction. i.e. without rotation. Here it is the same faces of the lumps which were the bearing faces when the lumps had been stabilized on the transporting surface, that are now opposite the extension of the steep transporting surface.

As the stock lumps move unsupported, the size of each lump across the width of the monolayer is evaluated, the lumps are each exposed to X-radiation, then the secondary characteristic radiation of valuable components in the lump is measured, and standard pieces are selected according to the measured values. On account of stabilized paths of the lumps, the measurement and lump selection operations are performed with the corresponding elements appropriately removed from the lumps. Moreover, the measurement of the secondary X-radiation from the lumps during their unsupported travel causes the background noise to be reduced.

Figure 1:
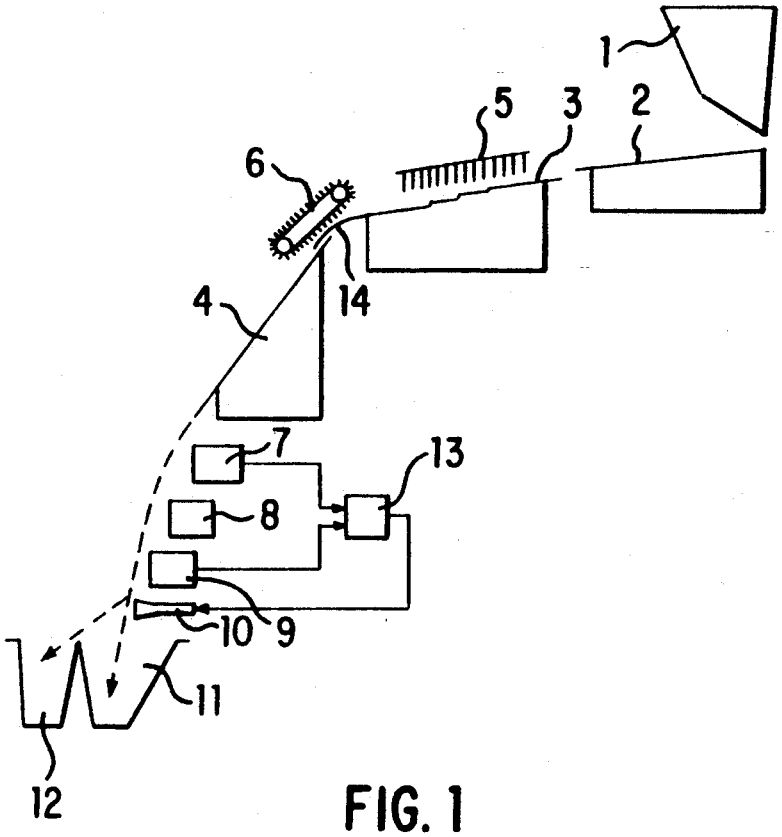
FIG. 1 is a schematic representation of the proposed apparatus for X-radiation sorting of raw materials.

The apparatus for X-radiation sorting of raw materials comprises a feed hopper 1 (FIG. 1) with the storage tank and the discharge means (not shown), a transportation device including three vibrating feeders 2, 3, 4, stabilizers 5 and 6, a coordinate system 7 for evaluation of lump sizes and their position across the width of the moving stream, X-radiation sources 8, X-radiation detectors 9, actuators such as pressure-operated valves 10, collecting tanks 11 and 12 for the classified pieces, and a computer 13. The coordinate system 7, the X-radiation sources 8, the X-radiation detectors 9, and the computer 13 are well-known devices, as will be shown hereinbelow. So they are not shown in more detail in the drawing.

The vibrating feeders 2, 3 have slightly inclined bearing surfaces, while the vibrating feeder 4 has a steep bearing surface, the vibrating feeder 4 including a curvilinear section 14 conjugate to the surface of the vibrating feeder 3.

The stabilizer 5 which, in combination with the vibrating feeder 3, serves to stabilize the stock lumps is located above the vibrating feeder 3 and formed by a stationary elastic brush. The stabilizer 6 implemented in the form of, say, a brush conveyer is located above the curvilinear section 14 of the vibrating feeder 4 and serves to compensate for the torques of the lumps being sorted, as they pass from the vibrating feeder 3 to the vibrating feeder 4. The stabilizers 5, 6 and the surfaces of their associated vibrating feeders must be so spaced from each other that the lumps are forced against these surfaces without being substantially braked.

The coordinate system 7, the X-radiation sources 8, the detectors 9, and the actuators 10 follow the steep vibrating feeder 4, looking downstream. The coordinate system 7 comprises light sources arranged across the movable lump mass and photodetectors located in line with them on the other side of the lump travel paths. The examples of such devices include examining posts at underground stations, devices for counting items moving on the conveyer, etc., whose operation is based on sensing the shadow of an object as it goes past the light sources. X-ray tubes or radionuclides can be employed as the X-radiation sources 8, and proportional, scintillation, or semiconductor counters, as the X-radiation detectors 9. The X-radiation sources 8, the X-radiation detectors 9, the pressure-operated valves 10, and the elements of the coordinate system 7 are uniformly distributed over the width of the stock lump stream.

The inputs of the computer 13 are connected to the outputs of the coordinate system 7 and to the outputs of the detectors 9, respectively, and the outputs thereof are connected to the pressure-operated valves 10. The computer 13 includes a pulse-height analyzer, an on-line processor, and a control unit for connection of the processor with the photodetectors of the coordinate system and with the actuators. Such devices are in common use, and they are described in literature such as SU-,A,915558 and SU,A,646737.

The apparatus operates as follows.

The raw material of a particular size range is fed through the feed hopper 1 to the first slightly inclined vibrating feeder 2 and then to the second slightly inclined vibrating feeder 3 providing a higher transportation speed than the first one, whereby the lumps are spread in monolayer. In addition, the vibrating feeder 3, in combination with the stabilizer 5, checks the steady position of the lumps. For this purpose, steps of a height equal to 0.10–0.2 of the average lump size of the class to be sorted are provided on the surface of the vibrating feeder 3. When passing the steps, the lump is tilted and its centre of gravity displaced with respect to the points of support of the bearing face. If the lump is not tipped over, the face on which it rests provides a sufficient stability for the lump to be advanced, while resting on this face. If the position of the lump is unstable, it will tip over on the next step to rest on another face, and so on, until it comes to rest on a "stable" face. Other means than the steps on the bearing surface of the vibrating feeder 3 may be used for stabilization of stock lumps, such as transverse rollers, ribs, etc. Adjusting the vibration frequency of the feeder 3, and the elastic force of the brush of the stabilizer 5, i.e. raising or lowering the brush above the surface of the feeder 3, conditions can be provided that prevent the lumps from rolling at the output of the vibrating feeder 3.

The vibrating feeder 3 also provides separation of the lumps from each other across the width of the stream, by such means as the enlarged surface of the vibrating feeder 3 in the downstream direction, and the diverging guides mounted thereon.

Advancing further, the lumps arrive at the steep vibrating feeder 4 and come to be located under the brush of the stabilizer 6. The speed of the brush conveyer of the stabilizer 6 is equal to that of the vibrofeed of the feeder 3, and the rotating sense is such that the lower conveyer branch facing the lumps being transported moves in the same direction as do the lumps. The lumps are forced by the brush against the surface of the vibrating feeders 3 and 4 at their adjacent portions, as it were, tracking the lumps without significant deceleration. In this case, the lump torques resulting from their being transferred to the steeply inclined transporting surface are suppressed, and the lumps are carried by the vibrating feeder 4, resting on the same faces as they do on the vibrating feeder 3. On the steep vibrating feeder 4, the lumps are accelerated and separated from those following them, allowing piece-by-piece measurements in the monolayer.

Figure 2A:
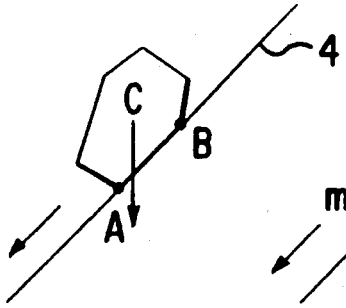
FIGS. 2*a*–2*c* illustrate the stock lumps moving down the steep vibrating feeder on the apparatus of FIG. 1.

The stable position of the lumps as they move along the vibrating feeder 4, relative to the direction of this movement, can be described as follows. As the lump is displaced by vibrofeed down the sloping surface, it "steps" over it, rather than slides along, i.e. it only contacts the surface at the time when this surface moves in the way opposite thereto. If it is the whole bearing face of the lump that contacts the vibrating feeder surface at the time of contact, the lump is pushed by a force exerted through its centre of gravity C (FIG. 2*a*). In this case, the lump is free from the torque.

Figure 2B:
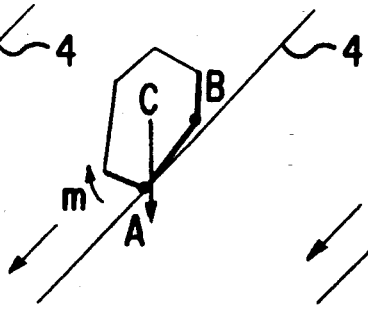
Figure 2C:
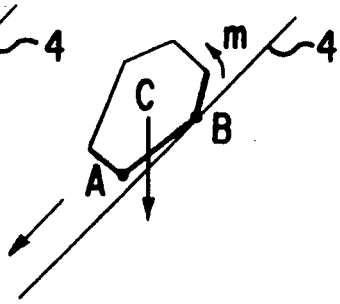

If, for some reason or other, it is the front point 'A' of the bearing face of the lump (FIG. 2*b*) that comes to be closest to the surface of the vibrating feeder 4 at the time of impact, the lump is subjected to a torque 'm' opposite to its feed direction, whereas if it is the back point 'B' of the bearing face (FIG. 2*c*), then the torque 'm' will be codirectional with the lump feed. Since the vibration amplitude of the feeder 4 is 0.5 to 1.0 mm and the vibration frequency is 100 to 400 Hz, the lump has no time, during the vibration period, to turn through more than a few degrees, and it is the opposite point of the same bearing surface that will get a push from the vibrating feeder at the next impact. So the lump 'steps' over the steep surface, rocking and getting gradually stabilized, the deviation from the straight path not exceeding 1 mm, so that the path can be considered as stabilized, with the accuracy sufficient for practical use.

After the lumps have left the steep vibrating feeder 4 (FIG. 1), they move on in monolayer unsupported, subject to the free fall acceleration, the deviation of their previously bearing faces from stable paths being not in excess of a few millimeters, which is negligible compared to the lump sizes, so that such paths can be thought of as stabilized.

With unsupported movement of the lumps, the coordinate system 7 determines the size of each of them, and more specifically, the projected area of each lump 'seen' by its photodetectors, as well as by the X-radiation sources 8 and the X-radiation detectors 9. The lumps are then exposed to X-radiation from the sources 8, while the detectors 9 detect the secondary radiation from each lump, i.e. the discrete characteristic spectrum of the desired component and the continuous (polyenergy) spectrum of the radiation by the lump. The signals of the detectors 8 in proportion to the amount of the useful component contained in the lump, together with the signals from the coordinate system 7, are applied to the computer 13 which processes these signals and determines the conformance of each lump to standard across the width of the monolayer, issuing a command to actuate those pressure-operated valves 10 whose position, across the monolayer width, corresponds to that of the standard pieces, the number of valves 10 actuated for selection of a single lump corresponding to the size of the lump as sensed by the coordinate system 7. As a result, the standard lumps are directed, say, to the collecting tank 12, and the sub-standard ones to the tank 11.

The stabilization of the paths of the stock lumps and their positions relative to their travelling direction enables the X-radiation sources 8 and the detectors 9, as well as the pressure-operated valves 10, to come as close to the lumps as practically possible. This results in an increased sensitivity of measurements, thus allowing the process of sorting the stock containing down to 0.5% of valuable components and reducing power consumption needed for actuation of the pressure-operated valves. So in the proposed method, the pressure-operated valves may be 1–2 cm spaced from the lumps, as opposed to the known method wherein, with the nonstabilized motion of the lumps in the valve area, this spacing is at least 5–8 cm. Consequently, the air consumption for pressure-operated valves, in the proposed method, is reduced by a factor of 15 to 25, since the air jet impact force decreases inversely with the squared spacing between the valve and the lump.

INDUSTRIAL APPLICABILITY

The invention is designed to be employed for preconcentration and sorting of the lump material in the size range of 15 to 200 mm, containing valuable components with the atomic number of no more than 20. The invention can be used in dressing mills, in cyclic production lines for concentration of ores, and in manufacturing systems for processing secondary metallic raw materials.

We claim:

1. A method of X-ray sorting of feedstock, consisting essentially of the steps of:

spreading lumps of the feed stock to be sorted on a small gradient conveying surface in a single layer across a width of the conveyor surface;

placing said lumps in said layer in a stable position;

transferring said lumps from the small gradient conveying surface to a high gradient conveying surface;

preventing rotation of said lumps during the transfer of said lumps to the high gradient conveying surface;

advancing said lumps by gravity acceleration in a single layer along the high gradient conveying surface as the high gradient conveying surface is vibrated to eliminate further rotation of the lumps;

discharging said lumps from a horizontal discharge line at a lower end of said high gradient conveyor;

further advancing said lumps in a single layer in an unsupported free fall state;

determining the dimensions of said freely falling lumps and their position over the width of the single layer;

irradiating said freely falling lumps with primary X-ray radiation for interacting with the lumps to produce a characteristic secondary X-ray radiation;

measuring the secondary X-ray radiation of each freely falling lump with a group of detectors;

determining the quality of each lump dependent on the measurements of the secondary X-ray radiation; and sorting said freely falling lumps dependent on the determination of quality.

2. An apparatus for X-ray sorting of feed stock, consisting essentially of:

a feed hopper for containing lumps of feed stock to be sorted;

a small gradient conveyor arranged under the feed hopper and provided with a vibrator, means for spreading the lumps in a single layer across a width of the conveyor, and means arranged over the conveyor to adjust the lumps into a stable position;

a high gradient conveyor mounted downstream of said small gradient conveyor along the path of movement of the lumps said high gradient conveyor having a vibrator and a horizontal discharge line to provide a single layer of stable unsupported lumps in a free fall state;

means to prevent rotation of the lumps, arranged at a joint between the small gradient and high gradient conveyors;

a coordinate system to determine the dimensions of the lumps and their position over the width of the single layer of free falling lumps, having electric outputs and provided in the immediate vicinity of said discharge line of said high gradient conveyor;

sources of primary X-ray radiation arranged in the immediate vicinity of said coordinate system along the path of movement of said freely falling single layer for directing X-ray radiation toward the lumps in said layer which interacts with the lumps for producing characteristic secondary X-ray radiation of the lumps;

a plurality of secondary X-ray radiation detectors, each of which has an electric output and which are positioned in the immediate vicinity of said plurality of primary X-ray radiation sources along the path of movement of said single layer of freely falling lumps for detecting said characteristic secondary X-ray radiation of the lumps;

a computing device having a plurality of inputs connected to the respective said outputs of the coordinate system and to the outputs of the secondary X-ray radiation detectors, and having a plurality of outputs; and a plurality of actuating means having control inputs connected to said outputs of said computer device for sorting the freely falling lumps of feed stock dependent on said outputs of said computing device.

* * * * *